US006758882B2

(12) United States Patent
Nakamura et al.

(10) Patent No.: US 6,758,882 B2
(45) Date of Patent: Jul. 6, 2004

(54) ALLOYED STEEL POWDER FOR POWDER METALLURGY

(75) Inventors: Naomichi Nakamura, Chiba (JP); Satoshi Uenosono, Chiba (JP); Shigeru Unami, Chiba (JP); Masashi Fujinaga, Chiba (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 10/255,280

(22) Filed: Sep. 26, 2002

(65) Prior Publication Data

US 2003/0056621 A1 Mar. 27, 2003

Related U.S. Application Data

(62) Division of application No. 09/934,188, filed on Aug. 21, 2001, now Pat. No. 6,610,120.

(30) Foreign Application Priority Data

Aug. 31, 2000 (JP) ..... 2000-263929
Aug. 14, 2001 (JP) ..... 2001-246254

(51) Int. Cl.[7] ..... B22F 1/00
(52) U.S. Cl. ..... 75/255
(58) Field of Search ..... 75/255

(56) References Cited

U.S. PATENT DOCUMENTS

| | | | | |
|---|---|---|---|---|
| 4,069,044 A | | 1/1978 | Mocarski et al. | 75/243 |
| 4,985,309 A | | 1/1991 | Ogura et al. | 428/570 |
| 5,571,305 A | | 11/1996 | Uenosono et al. | 75/246 |
| 5,876,481 A | | 3/1999 | Chagnon et al. | 75/255 |
| 5,938,814 A | * | 8/1999 | Uenosono et al. | 75/254 |
| 6,068,813 A | * | 5/2000 | Semel | 419/66 |

FOREIGN PATENT DOCUMENTS

| | | |
|---|---|---|
| EP | 334 968 | 10/1989 |
| GB | 1162702 | 8/1969 |
| JP | 611 30401 | 6/1986 |
| JP | 61 295302 | 12/1986 |
| JP | 01 123001 | 6/1989 |
| JP | 6-45802 | 6/1990 |
| JP | 2 145703 | 6/1990 |
| JP | 2-145703 | 6/1994 |
| JP | 2000-510907 | 8/2000 |

OTHER PUBLICATIONS

Kawasaki Steel, "Reduced Iron Powders Atomized Iron and Steel Powders" Feb. 1999, pp 1–21.

* cited by examiner

*Primary Examiner*—Ngoclan T. Mai
(74) *Attorney, Agent, or Firm*—Piper Rudnick LLP

(57) ABSTRACT

A Mo source powder is added to and mixed with an iron-based powder containing 1.0% by mass or less of prealloyed Mn to yield a powder mixture containing 0.2 to 10.0% by mass of Mo, the resulting powder mixture is subjected to heat treatment in a reducing atmosphere to thereby yield an alloyed steel powder containing Mo as a powder partially diffused and bonded to a surface of the iron-based powder particles. The prepared alloyed steel powder for powder metallurgy has satisfactory compactability. The use of this alloyed steel powder can produce a sintered powder metal body (an intermediate material after compaction and preliminary sintering in re-compaction of sintered powder materials process) for highly strong sintered member.

7 Claims, 2 Drawing Sheets

ALLOYED STEEL POWDER FOR POWDER METALLURGY

This application is a divisional or application Ser. No. 09/934,188, filed Aug. 21, 2001 now U.S. Pat. No. 6,610, 120, incorporated herein by reference.

BACKGROUND OF THE INVENTION

1. Field of the Invention

This invention relates to an iron-based powder which is suitable for use in various high strength sintered components. Specifically, this invention relates to an alloyed steel powder that can undergo re-compaction under a light load when it is applied to re-compaction of sintered powder preforms.

2. Description of the Related Art

Powder metallurgical technology can produce a component having a complicated shape as a "near net shape" with high dimensional accuracy and can markedly reduce the cost of cutting and/or finishing. In such a near net shape, almost no mechanical processing is required to obtain or form a target shape. Powder metallurgical products are, therefore, used in a variety of applications in automobiles and other various fields. For miniaturization and reduction in weight of components, demands have recently been made on such powder metallurgical products to have higher strength. Specifically, strong demands have been made on iron-based powder products (sintered iron-based components) to have higher strength.

A basic process for producing a sintered iron-based component (sometimes hereinafter referred to as "sintered iron-based compact" or simply as "sintered compact") includes the following sequential three steps (1) to (3): (1) a step of adding a powder for an alloy such as a graphite powder or copper powder and a lubricant such as zinc stearate or lithium stearate to an iron-based powder such as an iron powder or alloy steel powder to yield an iron-based mixed powder; (2) a step of charging the iron-based mixed powder into a die and pressing the mixed powder to yield a green compact; and (3) a step of sintering the green compact to yield a sintered compact. The resulting sintered compact is subjected to sizing or cutting according to necessity to thereby yield a product such as a machine component. When the sintered compact requires higher strength, it is subjected to heat treatment such as carburization or bright quenching and tempering. The resulting green compact obtained through the steps (1) to (2) has a density of at greatest from about 6.6 to about 7.1 $Mg/m^3$.

In order to further increase the strength of such iron-based sintered components, it is effective to increase the density of the green compact to thereby increase the density of the resulting sintered component (sintered compact) obtained by subsequent sintering. The component with a higher density has fewer pores and better mechanical properties such as tensile strength, impact value and fatigue strength.

A warm compaction technique, in which a metal powder is pressed while heating, is disclosed in, for example, Japanese Unexamined Patent Application Publication No. 2-156002, Japanese Examined Patent Application Publication No. 7-103404 and U.S. Pat. No. 5,368,630 as a process for increasing the green density. For example, 0.5% by mass of a graphite powder and 0.6% by mass of a lubricant are added to a partially alloyed iron powder in which 4 mass % Ni, 0.5 mass % Mo and 1.5 mass % Cu are contained, to yield an iron-based mixed powder. The iron-based mixed powder is subjected to the warm compaction technique at a temperature of 150° C. at a pressure of 686 MPa to thereby yield a green compact having a density of about 7.3 $Mg/m^3$. However, the density of the resulting green compact is about 93% of the density, and a further higher density is required. Additionally, application of the warm compaction technique requires facilities for heating the powder to a predetermined temperature. This increases production cost and decreases dimensional accuracy of the component due to thermal deformation of the die.

The sinter forging process, in which a green compact is directly subjected to hot forging, is known as a process for further increasing the density of a green compact. The sinter forging process can produce a product having a substantially true density but raises the cost beyond the other powder metallurgical processes, and the resulting component exhibits decreased dimensional accuracy due to thermal deformation.

As a possible solution to these problems, Japanese Unexamined Patent Application Publications No. 1-123005 and No. 11-117002 and U.S. Pat. No. 4,393,563, for example, propose a technique that can produce a product having a substantially true density as a combination of the powder metallurgical technology and re-compaction technology such as cold forging (the proposed technique is sometimes hereinafter referred to as "re-compaction of sintered powder preforms"). FIG. 3 shows an example of an embodiment of a production process of a sintered iron-based component using the re-compaction of sintered powder preforms.

With reference to FIG. 3, raw material powders such as a graphite powder and a lubricant are mixed with an iron-based material powder to yield an iron-based powder mixture. Next, the iron-based powder mixture is subjected to compaction to yield a preform, followed by preliminary sintering of the preform to yield a sintered iron-based powder metal body. Next, the sintered iron-based powder metal body is subjected to re-compaction such as by cold forging to yield a re-compacted body. The resulting re-compacted body is then subjected to re-sintering and/or heat treatment to thereby yield a sintered iron-based component.

This technique using re-compaction of sintered powder preforms is intended to increase the mechanical strength of the product (sintered iron-based component) by subjecting the sintered iron-based powder metal body to re-compaction to thereby increase the resulting density to a value near the true density. This technique can produce a component having high dimensional accuracy since there is less thermal deformation in the re-compaction step. However, to produce a sintered product having high strength by using this technique, (1) the sintered iron-based powder metal body must have high deformability and must be able to undergo re-compaction under a light load, and concurrently, (2) the sintered iron-based component after re-sintering and/or heat treatment must have high strength.

Separately, elements for improving quenching property are generally added to a iron-based powder to improve the strength of a sintered iron-based component.

For example, Japanese Examined Patent Application Publication No. 7-51721 mentions that, when 0.2 to 1.5% by mass of Mo and 0.05 to 0.25% by mass of Mn are prealloyed to an iron powder, the resulting sintered compact can have a high density without substantially deteriorating compressibility during compaction.

Japanese Examined Patent Application Publication No. 63-66362 discloses a powder metallurgical alloyed steel powder composed of an atomized alloyed steel powder and a powder (particle) of at least one of Cu and Ni partially diffused and bonded to a surface of the atomized alloyed steel powder, which atomized alloyed steel powder contains prealloyed Mo within a compositional range that does not adversely affect the compressibility of the powder. The publication mentions that this alloyed steel powder comprises prealloyed Mo and partially alloyed Cu or Ni to thereby concurrently obtain high compressibility during compaction and high strength of the component after sintering.

The alloyed steel powder described in Japanese Examined Patent Application Publication No. 63-66362 comprises partially alloyed Ni and/or Cu among alloying elements to ensure compressibility during compaction. However, Ni and Cu are highly diffusible into a steel powder matrix and diffuse into the steel powder matrix during preliminary sintering when the alloyed steel powder is subjected to a re-compaction of sintered powder preforms process. Accordingly, the resulting sintered iron-based powder metal body obtained through the provisional sintering step has a high hardness and requires a high load for re-compaction.

Likewise, the alloyed steel powder (iron-based powder) described in Japanese Examined Patent Application Publication No. 7-51721 is a prealloyed powder, and when this is subjected to re-compaction of sintered powder performs process, the resulting sintered iron-based powder metal body obtained through preliminary compaction and preliminary sintering has a high hardness and requires a high load for re-compaction. Consequently, the costs of facilities for re-compaction are increased or the life of the die is shortened.

Accordingly, the purpose of this invention is to provide an alloyed steel powder with excellent compressibility. This can solve the problems of the above mentioned conventional technologies, This can decrease the hardness of a sintered iron-based powder metal body obtained through compaction and preliminary sintering, can minimize the re-compaction load, and can increase the strength of a sintered iron-based component produced through re-sintering and/or heat treatment.

SUMMARY OF THE INVENTION

After intensive investigations on the composition of an iron-based material powder (iron-based powder) that is suitable for re-compaction of sintered powder preforms process, we have found that, when an iron-based powder contains prealloyed Mn and optionally Mo, based on the entire amount of said alloyed steel powder in an amount less than or equal to a predetermined amount, and contains Mo partially diffused and bonded to a surface of the iron-based powder within a predetermined range, the use of the iron-based powder, upon re-compaction of sintered powder preforms process, markedly decreases the re-compaction load and produces a sintered iron-based component after re-compaction and/or heat treatment which has high strength.

This invention has been accomplished based on these findings.

Accordingly, this invention provides an alloyed steel powder, including an iron-based powder and from about 0.2 to about 10.0% by mass of Mo in the form of a powder being partially diffused and bonded to the surface of the iron-based powder particles, which iron-based powder includes about 1.0% by mass or less of prealloyed Mn with the balance substantially consisting of iron.

This invention also provides an alloyed steel powder, including an iron-based powder and from about 0.2 to about 10.0% by mass of Mo in the form of a powder being partially diffused into and bonded to a surface of the iron-based powder particles, which iron-based powder includes about 1.0% by mass or less of prealloyed Mn and less than about 0.2% of prealloyed Mo with the balance substantially consisting of iron.

DETAILED DESCRIPTION OF THE INVENTION

Figure 1:
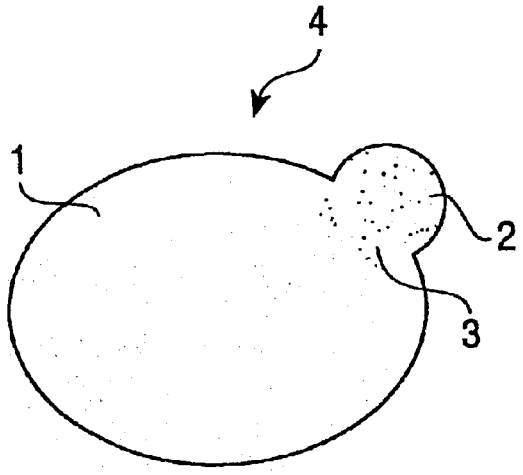
FIG. 1 is a schematic illustration showing an alloyed steel powder of the invention in which Mo is partially alloyed with iron as in the form of a powder.

Initially, the reasons for the specified composition of the alloyed steel powder of the invention will be described.

An iron-based powder for use as an iron-based material powder in the alloyed steel powder comprises about 1.0% by mass or less of prealloyed Mn and optionally less than 0.2% by mass of prealloyed Mo based on the total alloyed steel powder, with the balance of iron-based powder substantially consisting of iron.

Mn is an element for improving the hardenability and does not significantly increase the re-compaction load of a sintered iron-based powder metal body even when it is prealloyed. Accordingly, prealloyed Mn is contained in the iron-based powder to thereby improve the strength of the resulting sintered iron-based component (product) after heat treatment. If the content of Mn exceeds about 1.0% by mass, the hardenability is not significantly improved with an increasing amount of Mn, and the resulting sintered iron-based powder metal body has a somewhat high re-compaction load. The upper limit of Mn content is, therefore, specified as about 1.0% by mass considering also economical efficiency.

The aforementioned advantages can be obtained with a Mn content of equal to or more than about 0.02% by mass and more markedly with a Mn content of equal to or more than about 0.04% by mass. Accordingly, the content of Mn is preferably equal to or more than about 0.02% by mass and more preferably equal to or more than about 0.04% by mass. For these reasons, the Mn content in the iron-based powder is less than or equal to about 1.0% by mass, preferably from about 0.02 to about 1.0% by mass and more preferably from about 0.04 to about 1.0% by mass.

The balance of the iron-based powder other than Mn and optionally, Mo, substantially consists of iron. The term "substantially consists of iron" as used herein means the balance comprises Fe and inevitable impurities as well known in the art. Predominant major inevitable impurities include, for example, C, O, N, Si, P and S. To ensure compressibility of the iron-based powder mixture and to yield a preform having a sufficient density by compaction, the preferred contents of such inevitable impurities are C: about 0.05% by mass or less, O: about 0.3% by mass or less, N: about 0.005% by mass or less, Si: about 0.2% by mass or less preferably about 0.1% by mass or less, P: about 0.1% by mass or less, and S: about 0.1% by mass or less. There is no need to specify lower limits of the contents of these impurities from the viewpoint of quality of the sintered iron-based powder metal body. However, it is not economically efficient from the viewpoint of industrial productivity to reduce the contents lower than C: about 0.0005% by mass, O: about 0.002% by mass, N: about 0.0005% by mass, Si: about 0.005% by mass, P: about 0.001% by mass, and S: about 0.001% by mass.

The mean particle size of the iron-based powder for use in the invention is not specifically limited and is preferably in a range from about 30 to about 120 $\mu$m, within which the powder can be produced at an industrially appropriate cost. The term "mean particle size" as used herein means the 50% point of a cumulative particle size distribution ($d_{50}$) in weight.

The alloyed steel powder of the invention comprises Mo in the form of a powder partially diffused and bonded to the surface of the iron-based powder particles. The content of partially alloyed Mo in the form of a powder partially diffused and bonded to the surface of the iron-based powder particles is from about 0.2 to about 10.0% by mass based on the entire amount of alloy steel powder.

Mo is an element for improving the hardenability of the resulting sintered iron-based component and is contained in the alloyed steel powder to increase the strength of the sintered product. If the iron-based powder contains Mo as a prealloyed element, the resulting sintered iron-based powder metal body has an excessively high hardness to thereby decrease the re-compactability. Mo is, therefore, partially diffused and bonded to the surface of the iron-based powder particles and is partially alloyed to avoid high hardness at the powder metal body.

A partially alloyed Mo content of equal to or more than about 0.2% by mass improves hardenability, and the hardenability increases with an increase in the partially alloyed Mo content. In contrast, a partially alloyed Mo content exceeding about 10.0% by mass does not significantly improve the quenching property, thus failing to provide expected advantages appropriate to the content and inviting economically excessively increased cost. Additionally, excessive amounts of partially alloyed Mo may increase the re-compaction load. For these reasons, the content of partially alloyed Mo is specified as in a range from about 0.2 to about 10.0% by mass.

Furthermore the iron-based powder in the invention comprises about 1.0% by mass or less of prealloyed Mn and optionally less than about 0.2% of prealloyed Mo, both based on the total alloy steel powder, with the balance of iron-based powder substantially consisting of iron.

Mo is an element for improving the hardenability of the resulting sintered iron-based compact and is contained in the iron-based powder to increase the strength of the sintered product. Prealloyed Mo less than about 0.2% based on the total alloyed steel powder does not affect the re-compactability of the resulting sintered powder metal body after compaction and preliminary sintering.

FIG. 1 schematically shows the alloyed steel powder 4 in which Mo is partially alloyed in the form of a powder particle 2 which is partially diffused and bonded to a surface of the iron-based powder 1. In FIG. 1, only one Mo particle 2 is partially diffused and bonded to the surface the iron-based powder particle 1. However, more than one Mo particles 2 can be naturally diffused and bonded to the surface of the iron-based powder particle 1.

In alloyed steel powder particle 4, Mo powder particle 2 is partially diffused into, bonded to and partially alloyed with, a surface of iron-based powder particle 1. In the bonding portion between iron-based powder particle 1 and Mo source powder particle 2, part of Mo diffuses into iron-based powder particle 1 to form Mo diffused region 3 (an alloyed region), and the remainder Mo source powder particle 2 is bonded in the form of a powder to the surface of iron-based powder particle 1.

Preferred Mo source powders for use herein include but are not limited to, for example, a metal Mo powder, Mo oxide powder such as typically $MoO_3$ and ferromolybdenum powder.

Figure 3:
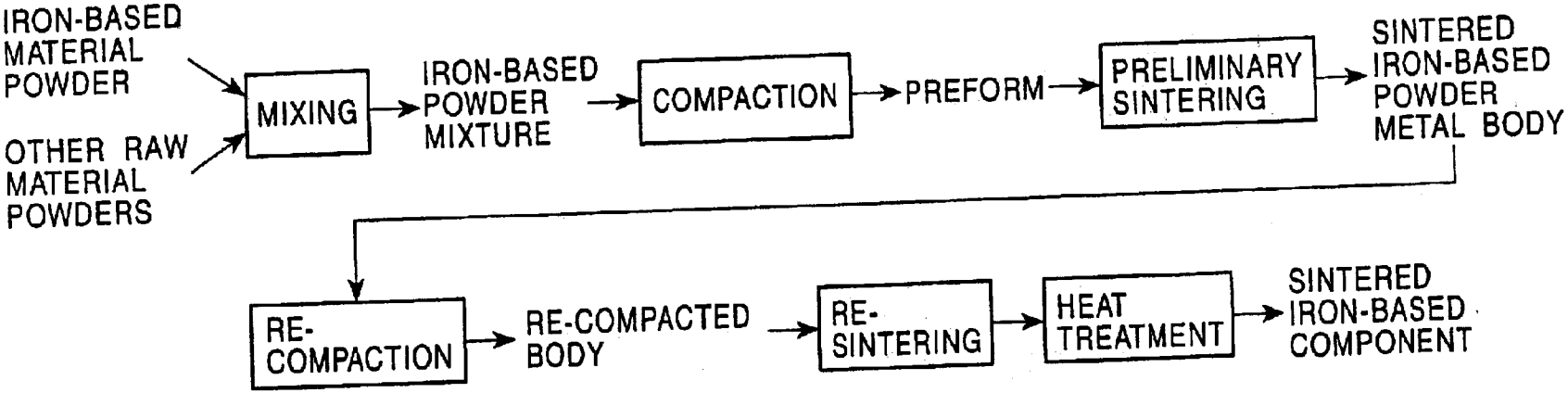
FIG. 3 is a schematic diagram showing an embodiment of process of re-compaction of sintered powder preforms.

The use of such alloyed steel powder as an iron-based material powder in re-compaction of sintered powder preforms process as shown in FIG. 3 yields the following advantages:

First, partially alloyed Mo does not fully disperse into the iron-based powder matrix even after preliminary sintering and therefore can undergo re-compaction under a light load to thereby yield a re-compacted body having a density near to the true density as compared with the use of a prealloyed steel powder having the same composition as an iron-based material powder. Further, the re-sintering operation of the re-compacted body having a density near to the true density enhances diffusion of Mo. The resulting sintered compact or the component obtained by subjecting the sintered compact to heat treatment such as gas carburization, vacuum carburization, bright quenching and tempering or induction quenching and tempering has equivalent strength to that obtained by using a prealloyed steel powder having the same composition as the iron-based material powder. Additionally, a particle of the invented alloyed steel powder has a lower hardness than a particle of prealloyed steel powder having the same composition, and can yield a sintered iron-based powder metal body having a higher density even when it is pressed at the same compaction pressure. In this connection, the higher the density of the sintered iron-based powder metal body is, the more preferable it is, in re-compaction of sintered powder preforms process.

The balance (remainder) of the alloyed steel powder other than Mn and Mo substantially consists of iron, namely Fe and inevitable impurities. To ensure compressibility of the iron-based powder mixture and to yield a preform having a sufficient density by compaction, the preferred contents of such incidental impurities are C: about 0.05% by mass or less, O: about 0.3% by mass or less, N: about 0.005% by mass or less, Si: about 0.2% by mass or less, preferably about 0.1% by mass or less, P: about 0.1% by mass or less, and S: about 0.1% by mass or less. There is no need to specify lower limits of the contents of these impurities in the allowed steel powder from the viewpoint of quality of the sintered iron-based powder metal body. However, it is not economically efficient from the viewpoint of industrial productivity to reduce the contents lower than C: about 0.0005% by mass, O: about 0.002% by mass, N: about 0.0005% by mass, Si: about 0.005% by mass, P: about 0.001% by mass, and S: about 0.001 by mass. The mean particle size of the alloyed steel powder for use in the invention is not specifically limited and is preferably in a range from about 30 to about 120 $\mu$m, within which the powder can be produced at an industrially appropriate cost.

Next, a process for producing the alloyed steel powder will be described below.

Figure 2:
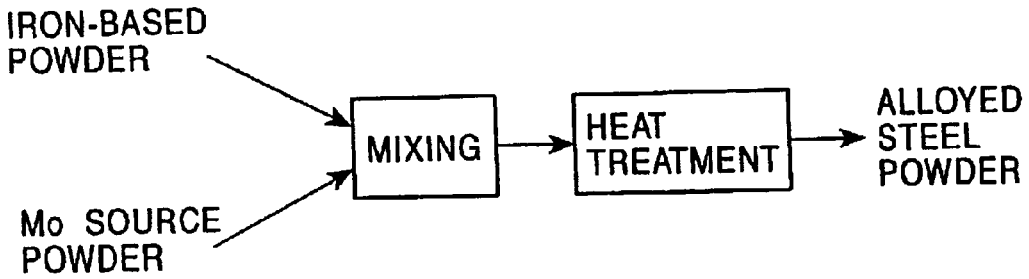
FIG. 2 is a diagram showing an embodiment of a production process for the alloyed steel powder of the invention.

FIG. 2 shows an embodiment of a production process for the alloyed steel powder of the invention. Initially, a Mo source powder and an iron-based powder containing prealloyed Mn and Mo optionally, in a predetermined amount are prepared. Both atomized iron powders and reduced iron powders can be used as the iron-based powder. Such atomized powders are generally subjected, after atomizing, to heat treatment in a reducing atmosphere such as hydrogen gas atmosphere to reduce carbon and oxygen. However, an atomized iron powder without such a reducing heat treatment can also be used in the invention.

A metal Mo powder, Mo oxide powder such as MoO and ferromolybdenum powder as mentioned before can be preferably used as the Mo source powder.

Subsequently, the iron-based powder is mixed with the Mo source powder in such a ratio that the Mo content in the resulting alloy steel powder falls within the aforementioned value range (from about 0.2 to about 10.0% by mass). Any of conventionally known means such as a Henshel-type mixer and conical mixer can be used for the mixing process. An adhesive agents such as spindle oil can be added upon mixing to improve adhesion between the iron-based powder and the Mo source powder. The amount of the adhensive agents is preferably from about 0.001 part by weight to about 0.1 part by weight relative to 100 parts by weight of the total amount of the iron-based powder and the Mo source powder.

Next, the resulting mixture composed of the iron-based powder and the Mo source powder is subjected to heat treatment at temperatures ranging from about 800° C. to about 1000° C. for about 10 minutes to about 3 hours in a reducing atmosphere such as an atmosphere of hydrogen gas atmosphere. This heat treatment allows Mo to partially diffuse into and bond to the surface of the iron-based powder particles to yield a partially alloyed steel powder. Even when a Mo oxide powder is used as the Mo source powder, the Mo oxide is reduced into a metal during the heat treatment step and the resulting metal Mo particle is partially diffused into and bonded to the surface of the iron-based powder particles to yield a partially alloyed steel powder as in the use of a metal Mo powder or ferromolybdenum powder as the Mo source powder.

The heat treatment for the formation of a partially alloyed powder permits the entire powder to be softly sintered and packed and, thus, the resulting powder is crushed and classified into a desired particle size and further subjected to annealing according to necessity to thereby ultimately yield an ultimate alloyed steel powder product.

Whether the Mo source powder is sufficiently diffused and bonded to the surface of iron-based powder can be evaluated by subjecting the cross sections of an individual alloy steel powder particles to elementary distribution analysis such as by well known electron probe microanalysis (EPMA). By mapping the distribution of Mo on the polished cross section of an alloy steel powder particle, the state of bonding of Mo source particle can be directly observed. When a Mo oxide is used as the Mo source powder and the content of oxygen in the alloy steel powder is sufficiently low (for example, less than or equal to about 0.3% by mass, the aforementioned impurity level), the Mo source powder can be evaluated as sufficiently dispersed and bonded without significant remaining Mo oxide.

The alloyed steel powder is then mixed with other raw material powders such as a graphite powder, alloying powder or lubricant according to necessity and is subjected to compaction and preliminary sintering to yield a sintered iron-based powder metal body. The sintered iron-based powder metal body is then subjected to re-compaction such as cold forging or roll forming and subjected to re-sintering and/or heat treatment according to necessity to yield a sintered iron-based component. The sintered iron-based powder metal body prepared by using the invented alloyed steel powder has such a light re-compaction load as to undergo sufficient re-compaction. However, the resulting sintered iron-based component obtained by re-sintering and/or heat treatment is a highly strong component having satisfactory hardenability.

The alloyed steel powder can be applied to applications that utilize high compactability and high strength after sintering and/or heat treatment in the entire field of powder metallurgy, in addition to the application as an iron-based material powder in re-compaction of sintered powder preforms process.

EXAMPLES

The invention will be illustrated in further detail with reference to several inventive examples, comparative examples and conventional examples below, which are not intended to limit the scope of the invention.

A series of iron-based powders containing prealloyed Mn and/or Mo indicated in Table 1 was prepared. The iron-based powder No. A2 was a water-atomized iron-based powder without reducing heat treatment, and the other powders were subjected to reduction in an atmosphere of hydrogen gas after atomizing. Each of these iron-based powders was mixed with a Mo source powder indicated in Tables 2 and 3 in a predetermined ratio in the resulting alloyed steel powder indicated in Tables 2 and 3. Next, 0.01 part by weight of spindle oil as an adhesive agent was then added to 100 parts by weight of the total amount of the iron-based powder and the Mo source powder, and the resulting mixture was blended in a V-type mixer for 15 minutes to thereby yield a mixed powder. In conventional examples (alloyed steel powders No. 24 to No. 26), a metal Ni powder and/or a metal Cu powder was added to an iron-based powder containing prealloyed Mo (iron-based powder No. E) in a predetermined ratio in the resulting alloyed steel powder indicated in Table 3.

Each of these mixed powders was subjected to heat treatment at 900° C. in an atmosphere of hydrogen gas for 1 hour to partially diffuse and bond the Mo source powder to surfaces of the iron-based powder particles to thereby yield a partially alloyed steel powder.

Each of the obtained alloyed steel powders was chemically analyzed and found to contain less than or equal to 0.01% by mass of C, less than or equal to 0.25% by mass of O and less than or equal to 0.0030% by mass of N. Even when the water-atomized iron-based powder No. A2 was used, the iron powder was reduced during the heat treatment, and the oxygen content in the resulting powder was decreased to 0.25% by mass or less. The contents of Si, P and S in the iron-based powders and the alloy steel powders were each less than or equal to 0.05% by mass.

The cross section of each of the obtained alloyed steel powders was subjected to EPMA to verify that the Mo source powder was bonded to a surface of the iron-based powder and was partially diffused. In this analysis, 50 particles of the alloyed steel powder were analyzed. Each of the alloy steel powder particles had a mean particle size of from 60 to 80 $\mu$m.

Next, 0.2% by mass of natural graphite and 0.3% by mass of zinc stearate (lubricant) were added to each of the above-prepared alloyed steel powders to yield an iron-based mixed powder mixture. The amounts of the graphite and zinc stearate were indicated in amounts relative to the total weight of the iron-based powder mixture. The iron-based powder mixture was then charged into a die and compacted to yield a tablet-shaped preform of 30 mm in diameter and 15 mm in height. The preform was then subjected to preliminary sintering at 1100° C. in an atmosphere of hydrogen gas for 1800 seconds to yield a sintered iron-based powder metal body. The load applied during compaction was set so that the density of the resulting sintered iron-based powder metal body became 7.4 $Mg/m^3$.

Each of the above-prepared sintered iron-based powder metal bodies was subjected to re-compaction. Specifically, it was subjected to cold forging in the form of a cup at an area reduction rate of 80% by backward extrusion to thereby yield a cup-shaped body. The load applied during cold forging was measured.

The cup-shaped body was then subjected to re-sintering at 1140° C. in an atmosphere of nitrogen 80 vol. %-hydrogen 20 vol. % for 1800 seconds, was held at 870° C. in a carburizing atmosphere of at a carbon potential of 1.0% for 3600 seconds, was quenched in an oil, and was tempered at 150° C. As a result of these heat treatments, a cup-shaped body was obtained. A surface hardness in Rockwell C (HRC) scale of the resulting cup-shaped body was measured. These results are shown in Tables 2 and 3.

TABLE 1

| Iron-based powder No. | Type | Chemical composition (% by mass) C | O | Mn | Mo |
|---|---|---|---|---|---|
| A1 | Water-atomized powder | 0.007 | 0.15 | 0.14 | — |
| A2 | Water-atomized powder | 0.15 | 0.75 | 0.14 | — |

TABLE 1-continued

| Iron-based powder No. | Type | Chemical composition (% by mass) C | O | Mn | Mo |
|---|---|---|---|---|---|
| B | Reduced powder | 0.004 | 0.21 | 0.20 | — |
| C1 | Water-atomized powder | 0.006 | 0.14 | 0.10 | — |
| C2 | | 0.008 | 0.14 | 0.33 | — |
| C3 | | 0.010 | 0.15 | 0.45 | — |
| C4 | | 0.007 | 0.13 | 0.70 | — |
| C5 | | 0.009 | 0.13 | 1.20 | — |
| D1 | Water-atomized powder | 0.008 | 0.13 | 0.16 | 0.56 |
| D2 | | 0.009 | 0.14 | 0.21 | 1.50 |
| D3 | | 0.006 | 0.13 | 0.15 | 1.99 |
| E | Water-atomized powder | 0.007 | 0.14 | 0.05 | 0.60 |
| F | Water-atomized powder | 0.007 | 0.13 | 0.14 | 0.14 |

A2: Water-atomized powder without additional treatment

TABLE 2

| Alloy steel powder No. | Composition: Iron-based powder No. | Secondary material powder Type | Alloy content (% by mass): Prealloyed amount: Mn (in iron-based powder) | Mn (in alloyed steel powder) | Mo (in iron-based powder) | Mo (in alloyed steel powder) | Diffused and bonded amount: Mo | Ni | Cu |
|---|---|---|---|---|---|---|---|---|---|
| 1 | A1 | $MoO_3$ powder | 0.14 | 0.14 | — | — | 0.57 | — | — |
| 2 | | $MoO_3$ powder | 0.14 | 0.14 | — | — | 1.02 | — | — |
| 3 | | $MoO_3$ powder | 0.14 | 0.14 | — | — | 1.48 | — | — |
| 4 | | $MoO_3$ powder | 0.14 | 0.14 | — | — | 1.98 | — | — |
| 5 | | $MoO_3$ powder | 0.14 | 0.13 | — | — | 4.20 | — | — |
| 6 | | $MoO_3$ powder | 0.14 | 0.13 | — | — | 6.41 | — | — |
| 7 | A2 | $MoO_3$ powder | 0.14 | 0.14 | — | — | 0.57 | — | — |
| 8 | A1 | $MoO_3$ powder | 0.13 | 0.12 | — | — | 10.3 | — | — |
| 9 | B | $MoO_3$ powder | 0.20 | 0.20 | — | — | 0.54 | — | — |
| 10 | | $MoO_3$ powder | 0.20 | 0.20 | — | — | 0.98 | — | — |
| 11 | | $MoO_3$ powder | 0.20 | 0.20 | — | — | 1.51 | — | — |
| 12 | | $MoO_3$ powder | 0.20 | 0.19 | — | — | 4.24 | — | — |
| 13 | | $MoO_3$ powder | 0.20 | 0.19 | — | — | 6.29 | — | — |
| 14 | | $MoO_3$ powder | 0.20 | 0.18 | — | — | 10.4 | — | — |

| Alloy steel powder No. | Re-compaction Load kN | Hardness after heat treatment HRC | Remarks |
|---|---|---|---|
| 1 | 140 | 58 | Inventive Example |
| 2 | 145 | 59 | Inventive Example |
| 3 | 150 | 61 | Inventive Example |
| 4 | 154 | 61 | Inventive Example |
| 5 | 161 | 61 | Inventive Example |
| 6 | 167 | 62 | Inventive Example |
| 7 | 141 | 58 | Inventive Example |
| 8 | not forgeable | — | Comparative Example |
| 9 | 146 | 58 | Inventive Example |
| 10 | 152 | 59 | Inventive Example |

TABLE 2-continued

| | | | |
|---|---|---|---|
| 11 | 159 | 60 | Inventive Example |
| 12 | 165 | 61 | Inventive Example |
| 13 | 169 | 61 | Inventive Example |
| 14 | not forgeable | — | Comparative Example |

TABLE 3

| Alloy steel powder No. | Composition: Iron-based powder No. | Composition: Secondary material powder Type | Alloy content (% by mass): Prealloyed amount: Mn (in iron-based powder) | Prealloyed amount: Mn (in alloyed steel powder) | Prealloyed amount: Mo (in iron-based powder) | Prealloyed amount: Mo (in alloyed steel powder) | Diffused and bonded amount: Mo | Diffused and bonded amount: Ni | Diffused and bonded amount: Cu |
|---|---|---|---|---|---|---|---|---|---|
| 15 | C1 | Metal Mo powder | 0.10 | 0.10 | — | — | 0.60 | — | — |
| 16 | C2 | Metal Mo powder | 0.33 | 0.33 | — | — | 0.61 | — | — |
| 17 | C3 | Metal Mo powder | 0.45 | 0.45 | — | — | 0.62 | — | — |
| 18 | C4 | Metal Mo powder | 0.70 | 0.70 | — | — | 0.58 | — | — |
| 19 | C5 | Fe—Mo powder | 0.10 | 0.10 | — | — | 0.59 | — | — |
| 20 | C6 | Metal Mo powder | 1.20 | 1.19 | — | — | 0.60 | — | — |
| 21 | D1 | — | 0.16 | 0.16 | 0.56 | 0.56 | — | — | — |
| 22 | D2 | — | 0.21 | 0.21 | 1.50 | 1.50 | — | — | — |
| 23 | D3 | — | 0.15 | 0.15 | 1.99 | 1.99 | — | — | — |
| 24 | E | Metal Ni powder | 0.05 | 0.05 | 0.60 | 0.59 | — | 2.00 | — |
| 25 | | Metal Cu powder | 0.05 | 0.05 | 0.60 | 0.59 | — | — | 1.50 |
| 26 | | Metal Ni powder<br>Metal Cu powder | 0.05 | 0.05 | 0.60 | 0.59 | — | 1.50 | 1.00 |
| 27 | A1 | $MoO_3$ powder | 0.14 | 0.14 | — | — | 0.12 | — | — |
| 28 | F | $MoO_3$ powder | 0.14 | 0.14 | 0.14 | 0.14 | 1.39 | — | — |
| 29 | D1 | $MoO_3$ powder | 0.16 | 0.16 | 0.56 | 0.56 | 0.92 | — | — |

| Alloy steel powder No. | Re-compaction Load kN | Hardness after heat treatment HRC | Remarks |
|---|---|---|---|
| 15 | 141 | 58 | Inventive Example |
| 16 | 148 | 59 | Inventive Example |
| 17 | 159 | 60 | Inventive Example |
| 18 | 168 | 61 | Inventive Example |
| 19 | 141 | 58 | Inventive Example |
| 20 | 177 | 60 | Comparative Example |
| 21 | 155 | 60 | Comparative Example |
| 22 | 170 | 61 | Comparative Example |
| 23 | 175 | 60 | Comparative Example |
| 24 | 175 | 60 | Comparative Example |
| 25 | 174 | 59 | Comparative Example |
| 26 | 177 | 60 | Comparative Example |
| 27 | 138 | 35 | Comparative Example |
| 28 | 153 | 60 | Inventive Example |
| 29 | 162 | 61 | Comparative Example |

Fe—Mo powder: 61% by mass Mo—Fe powder.

Each of the inventive examples utilized a low load for cold forging (re-compaction) and showed satisfactory re-compactability. Comparisons of the alloyed steel powders No. 1 with No. 21, No. 4 with No. 23, and No. 11 with No. 22 show that partial diffusion and bonding and partial alloying of Mo can reduce the load for cold forging (re-compaction). The inventive examples required a remarkably lower load for cold forging (re-compaction) than conventional examples (alloyed steel powders No. 24 to No. 26) containing prealloyed Mo of 0.2% or more and partially alloyed Ni and/or Cu obtained by partial diffusion and bonding of Ni and/or Cu.

Each of the inventive examples had a surface hardness in HRC scale of equal to or more than 58 after heat treatment, exhibited comparatively high hardness and became a highly strong iron-based sintered component as compared with the hardness after heat treatment of the comparative examples (alloy steel powders No. 21 to No. 23) containing prealloyed both Mn and Mo and of the conventional examples (alloy steel powders No. 24 to No. 26) containing prealloyed Mo and partially alloyed Cu and/or Ni. In contrast, comparative examples (alloy steel powders No. 8 and No. 14) containing a large amount of Mo exhibited decreased re-compactability and could not be molded to predetermined dimensions during re-compaction. A comparative example (alloy steel powder No. 20) containing a large amount of prealloyed Mn required a load for re-compaction as high as the conventional examples (alloyed steel powders No. 24 to No. 26). A comparative example (alloyed steel powder No. 27) containing a small amount of Mo exhibited low hardness after heat treatment. Further, comparison of alloyed steel powder No. 28 with No. 22 shows that the load for cold forging (re-compaction) is kept low even though Mo is prealloyed, if the content of prealloyed Mo is within the scope of invention. On the other hand, comparison of alloy steel powder No. 28 with No. 29 shows that the load for cold forging grows high when the content of prealloyed Mo exceed the scope of the invention.

As described above, the invention improves deformation capability of a sintered iron-based powder metal body, produces a high density re-compacted body having a density near to the true density, produces a highly strong sintered iron-based component having high dimensional accuracy and achieves remarkable industrial advantages.

Other embodiments and variations will be obvious to those skilled in the art, and this invention is not to be limited to the specific matters stated above.

What is claimed is:

1. An alloyed steel powder for powder metallurgy, comprising:

an iron-based powder consisting essentially of about 0.1 to about 1.0% by mass of prealloyed Mn based on the entire amount of said alloyed steel powder with the balance substantially consisting of iron; and from about 0.2 to about 10.0% by mass of Mo based on the entire amount of said alloyed steel powder in the form of a powder being partially diffused into and bonded to a surface of said iron-based powder particles, wherein Mo is the only particle partially diffused into and bonded to the surface of said iron-based powder particles.

2. An alloyed steel powder for powder metallurgy consisting essentially of:

an iron-based powder containing about 1.0% by mass or less of prealloyed Mn based on the entire amount of said alloyed steel powder, inevitable impurities and the balance substantially consisting of iron; and from about 0.2 to about 10.0% by mass of Mo based on the entire amount of said alloyed steel powder in the form of a powder being partially diffused into and bonded to a surface of said iron-based powder particles, wherein the inevitable impurities are selected from the group consisting of C: about 0.05% by mass or less, O: about 0.3% by mass or less, N: about 0.005% by mass or less, Si: about 0.2% by mass or less preferably about 0.1% by mass or less, P: about 0.1% by mass or less, and S: about 0.1% by mass or less.

3. An alloyed steel powder for powder metallurgy, comprising:

an iron-based powder, said iron-based powder comprising about 1.0% by mass or less of prealloyed Mn based on the entire amount of said alloyed steel powder with the balance substantially consisting of iron; and from about 0.2 to about 10.0% by mass of Mo based on the entire amount of said alloyed steel powder in the form of a powder being partially diffused into and bonded to a surface of said iron-based powder particles, wherein Mo is the only particle partially diffused into and bonded to the surface of said iron-based powder particles, wherein the mean particle size of the alloyed steel powder is in a range of from about 30 to about 120 $\mu$m.

4. An alloyed steel powder for powder metallurgy consisting essentially of:

an iron-based powder containing about 1.0% by mass or less of prealloyed Mn based oh the entire amount of said alloyed steel powder, inevitable impurities and the balance substantially consisting of iron; and from about 0.2 to about 10.0% by mass of Mo based on the entire amount of said alloyed steel powder in the form of a powder being partially diffused into and bonded to a surface of said iron-based powder particles, wherein the mean particle size of the alloyed steel powder is in a range of from about 30 to about 120 $\mu$m.

5. An alloyed steel powder for powder metallurgy, comprising:

an iron-based powder consisting essentially of about 1.0% by mass or less of prealloyed Mn and prealloyed Mo, wherein the prealloyed Mo is present, but in an amount less than about 0.2% by mass, and the amounts of Mn and Mo are based on the entire amount of said alloyed steel powder with the balance substantially consisting of iron; and from about 0.2 to about 10.0% by mass of Mo based on the entire amount of said alloyed steel powder in the form of a powder being partially diffused into and bonded to a surface of said iron-based powder particles, wherein Mo is the only particle partially diffused into and bonded to the surface of said iron-based powder particles.

6. An alloyed steel powder for powder metallurgy consisting essentially of:

an iron-based powder containing about 1.0% by mass or less of prealloyed Mn and less than about 0.2% by mass of prealloyed Mo based on the entire amount of said alloyed steel powder, inevitable impurities and the balance substantially consisting of iron; and from about 0.2 to about 10.0% by mass of additional Mo based on the entire amount of said alloyed steel powder in the form of a powder being partially diffused into and bonded to a surface of said iron-based particles.

7. An alloyed steel powder for powder metallurgy, comprising:

an iron-based powder, said iron-based powder comprising about 1.0% by mass or less of prealloyed Mn and prealloyed Mo, wherein the prealloyed Mo is present, but in an amount less than about 0.2% by mass, and the amounts of Mn and Mo are based on the entire amount of said alloyed steel powder with the balance substantially consisting of iron; and from about 0.2 to about 10.0% by mass of Mo based on the entire amount of said alloyed steel powder in the form of a powder being partially diffused into and bonded to a surface of said iron-based powder particles.

* * * * *